US006059269A

United States Patent [19]

Ross

[11] Patent Number: 6,059,269

[45] Date of Patent: May 9, 2000

[54] MODULAR STAIRWAY AND BALCONY RAILING SYSTEM

[76] Inventor: Nancy A. Ross, 5423 Preston Fairways Cir., Dallas, Tex. 75252

[21] Appl. No.: 09/056,517

[22] Filed: Apr. 7, 1998

Related U.S. Application Data

[63] Continuation-in-part of application No. 08/743,300, Nov. 5, 1996, Pat. No. 5,820,111.

[51] Int. Cl.[7] ..... E04F 11/18

[52] U.S. Cl. ..... 256/65; 256/21; 256/59

[58] Field of Search ..... 256/65, 59, 21, 256/22, 24

[56] References Cited

U.S. PATENT DOCUMENTS

| | | | |
|---|---|---|---|
| 8,149 | 6/1851 | Crowell | 256/22 |
| 20,797 | 7/1858 | Homes | 256/22 |
| 92,118 | 6/1869 | Sommer | 256/21 |
| 116,657 | 7/1871 | Wood | 256/22 X |
| 444,960 | 1/1891 | Friday | 256/22 |
| 764,953 | 7/1904 | London | 256/24 |
| 897,571 | 9/1908 | Bayley . | |
| 1,312,242 | 8/1919 | Ferris | 256/22 |
| 1,664,080 | 3/1928 | Mapson | 256/22 |
| 1,914,913 | 6/1933 | Ferris | 256/22 |
| 2,655,345 | 10/1953 | Lindman | 256/22 |
| 2,715,513 | 8/1955 | Kools | 256/21 |
| 2,823,014 | 2/1958 | Schrage | 256/21 |
| 2,840,349 | 6/1958 | Raymond | 256/21 |
| 2,870,996 | 1/1959 | Helt | 256/22 |
| 2,909,361 | 10/1959 | Dotson | 256/21 |
| 2,976,018 | 3/1961 | Dellagala | 256/21 |
| 3,092,372 | 6/1963 | Cougle | 256/22 |
| 3,491,984 | 1/1970 | Nyberg | 256/21 |
| 3,689,032 | 9/1972 | Von Wedel et al. | 256/22 |
| 3,736,720 | 6/1973 | Larson | 256/22 X |
| 3,960,367 | 6/1976 | Rogers | 256/21 |
| 4,006,885 | 2/1977 | Unterberger | 256/59 |
| 4,386,761 | 6/1983 | Kato | 256/21 |
| 4,684,108 | 8/1987 | Bergagnini | 256/24 |
| 5,029,818 | 7/1991 | Katz | 256/22 |
| 5,624,103 | 4/1997 | Venegas, Jr. | 256/19 X |

*Primary Examiner*—Anthony Knight
*Assistant Examiner*—Alison K Pickard
*Attorney, Agent, or Firm*—Akin, Gump, Strauss, Hauer & Feld, LLP

[57] ABSTRACT

A modular railing system for straight or curved stairways and straight or curved balconies includes a selected number of balusters, each having a stanchion for connection to a base support member of the balcony or stairway and a handrail member of the balcony or stairway railing system and a barrier part connected to the stanchion. The barrier parts may comprise predetermined ornamental scroll-shaped portions connected to the stanchions at spaced apart points between opposite distal ends of the stanchions and projecting laterally from the stanchions. Alternatively, the stanchions may project from opposite ends of the barrier part. Each baluster has a predetermined ornamental and functional shape to provide a repeating pattern of the railing system throughout its extent and to provide a maximum pass-through dimension to comply with regulatory requirements. The stanchion parts and barrier parts of each baluster are proportioned to provide modular railings for stairways having substantial differences in slopes. The balusters are preferably fabricated of wrought iron or other workable metals and the barrier parts of each baluster may be formed to have a predetermined radius of curvature out of a vertical plane for use in conjunction with curved stairways or balconies.

14 Claims, 12 Drawing Sheets

MODULAR STAIRWAY AND BALCONY RAILING SYSTEM

CROSS REFERENCE TO RELATED APPLICATION

This application is a continuation in part of application Ser. No. 08/743,300 filed Nov. 5, 1996 now U.S. Pat. No. 5,820,111 issued Oct. 13, 1998.

FIELD OF THE INVENTION

The present invention pertains to a modular stairway and balcony railing system comprising selected ornamental balusters which may be arranged in predetermined patterns and to provide straight or curved stairway and balcony railings.

BACKGROUND OF THE INVENTION

Stairway and balcony railings of myriad designs and types have been developed for both residential dwelling stairways and balconies, commercial building stairways and balconies and exterior stairways, balconies or walkways requiring or desirably needing protective and ornamental railings.

Although many prior, so-called modular, railing systems have been developed, these systems tend to be particularly complicated, not easily adapted for providing stairway railings at different stairway slopes or angles to the horizontal and requiring rather complex and costly installation procedures. Alternatively, many ornamental stairway and balcony railing systems, particularly for residential dwelling structures, are typically prefabricated as a complete railing unit or custom fabricated at the installation site. Prefabrication and transport of a complete railing unit to the installation site is often difficult and cumbersome. In many instances the final dimensions of a balcony or stairway may change during construction and, accordingly, a prefabricated system may not fit at installation. On-site installation of prior art type stairway and balcony railings has been somewhat costly and time consuming.

Accordingly, there has been a long-felt need for improvements in ornamental stairway and balcony railing systems for residential dwelling installations, in particular. However, the short-comings of prior efforts in the fabrication and erection of stairway and balcony railings has also been felt for applications in commercial buildings and outdoor stairway and balcony railing installations.

One improvement which has been sought is the simplification of the railing components while providing for decorative and ornamental features which can be somewhat customized for each installation. In this regard it is desirable for the railing to be made up of relatively few parts which may be repeated in a particular pattern as well as arranged in different patterns at other installations so that each application appears to have a custom or semi-custom installation. Another long sought improvement is for a railing system which can be easily adapted to stairways of different slopes or angle of inclination from the horizontal along the stairway rail or stringer. Still further, there has been a desire to provide modular stairway and balcony railing component parts which may be easily formed as curved elements of a selected radius of curvature so that a continuously curved railing system may be provided when needed, which has a custom appearance and yet is made up of a relatively few number of prefabricated railing parts or panels. It is to these ends that the present invention has been developed.

SUMMARY OF THE INVENTION

The present invention provides a modular stairway and/or balcony railing system utilizing a relatively few number of parts which may be easily prefabricated and assembled at the installation site to provide a railing system having a unique ornamental appearance.

In accordance with one aspect of the present invention, a plurality of balcony or stairway railing members or balusters is provided, each being of a selected ornamental design, and each being formed to have a stanchion part and an ornamental barrier part to form a baluster or railing panel. The balusters may be easily prefabricated as flat, generally planar elements or curved in one direction or the other so that a railing system may be erected using a relatively few number of parts in both straight or curved balcony railing configurations or in straight or curved stairway railing configurations.

In accordance with another important aspect of the present invention, a balcony and stairway railing system is provided which is adapted to include parts which may be prefabricated and combined into a system which may be installed on virtually any balcony or stairway regardless of the radius of curvature of the balcony or stairway or the slope of the stairway and wherein the ornamental appearance of the railing system will be substantially the same regardless of the radius of curvature of the balcony or stairway or the slope of the stairway.

In particular, it has been determined that a railing system utilizing the components of the present invention, when made up of balusters which are curved out of a plane which includes a rodlike stanchion part of the baluster, may be formed to have a single radius of curvature which can be used for virtually all balcony and stairway railing radii of curvature. Accordingly, baluster members may be fabricated of single or plural spaced apart rodlike stanchion parts with ornamental scrollwork barrier parts of the baluster extending substantially from one side of the stanchion parts and which may be curved in opposite directions, as desired, to form a baluster part which is "convex" or "concave". In this way the baluster parts may be used for balcony and stairway railings curving in either direction and the baluster parts may be used in alternating inverted and upright positions within the railing system to maintain a predetermined ornamental pattern and while meeting the curvature requirements of the balcony or stairway railing.

The present invention also provides an improved modular ornamental railing system made up of plural railing members or balusters which are each characterized by a generally vertical rodlike stanchion member connected to one or more ornamental barrier parts, preferably somewhat scroll-shaped parts, to provide a railing system which forms a barrier of predetermined proportions and to meet certain regulatory requirements regarding protective railings for stairways and balconies and the like.

In accordance with another aspect of the present invention, railing members are provided which are adapted for use in modular, continuous stairway or balcony railings and are each characterized by a vertical rodlike stanchion and ornamental barrier parts attached to or formed integral with a stanchion and configured in such a way that when plural railing members are arranged in a predetermined pattern for either a stairway railing system or a balcony railing system, that an aesthetically pleasing railing is provided which also meets requirements for protective barriers. The railing members may be easily prefabricated to have a generally planar, concave or convex curved configuration for use in straight or curved railing arrangements. The railing members are also configured in such a way that a relatively few number of different railing members are required to provide a railing system.

Those skilled in the art will further appreciate the above-mentioned features and advantages of the invention together with other superior aspects thereof upon reading the detailed description which follows in conjunction with the drawings.

DESCRIPTION OF THE PREFERRED EMBODIMENTS

Figure 1:
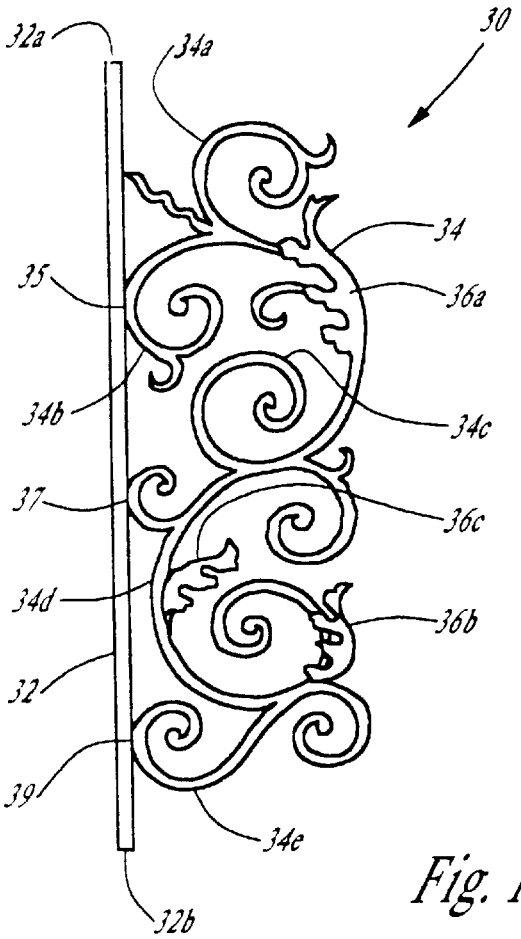
FIG. 1 is a side elevation of a railing member or baluster for use with the stairway and balcony railing system of the present invention.

In the description which follows, like parts are marked throughout the specification and drawing with the same reference numerals, respectively. The drawing figures are not necessarily to scale in the interest of clarity of the inventive features.

Referring to FIG. 1, there is illustrated an exemplary stairway or balcony railing member or baluster in accordance with the invention and generally designated by the numeral 30. The baluster 30 includes an elongated substantially straight rodlike stanchion having opposed distal ends 32*a* and 32*b*. An ornamental scroll barrier part generally designated by numeral 34, is suitably attached to stanchion part 32 between its distal ends. The barrier part 34 extends laterally from one side of the stanchion 32 and may be made up of a plurality of ornamental scroll shaped portions 34*a*, 34*b*, 34*c*, 34*d* and 34*e*, for example. The barrier part 34 may be suitably secured to the stanchion 32 by conventional mechanical fasteners or by welding or other bonding methods at securement points 35, 37 and 39, for example. Those skilled in the art will appreciate that the barrier part 34 may have different ornamental configurations and may be made up of curved portions such as identified herein and shown in FIG. 1, or characterized by other shapes. In a preferred embodiment of the invention, the stanchion 32 comprises a square cross-section iron rod having a nominal side dimension of 0.75 inches and the part 34 is made up of square or round cross section iron rod bent to the configuration shown and built up of several component parts, if necessary. The nominal cross section dimension of the rod making up part 34 may be 0.50 inches to 0.75 inches, for example. Additional ornamental features or portions of part 34 may be provided such as indicated at 36*a*, 36*b* and 36*c*, for example. These features may also comprise wrought metal members suitably secured to the part 34 such as by welding or other conventional fastening methods.

Figure 2:
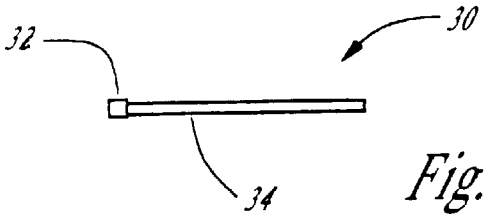
FIG. 2 is a top plan view of the railing member shown in FIG. 1.
Figure 3:
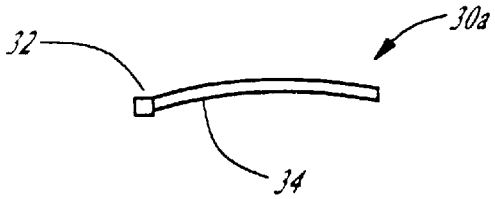
FIG. 3 is a top plan view of an alternate embodiment of the railing member shown in FIG. 1 having a somewhat concave curved configuration.
Figure 4:
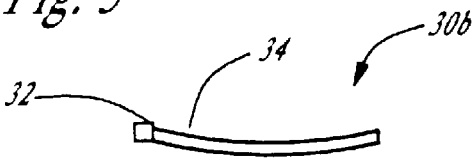
FIG. 4 is a top plan view of another embodiment of the railing member shown in FIG. 1 having a somewhat convex curved configuration.

As shown in FIG. 2, the baluster 30 has a generally planar configuration when viewed from an end or side. A top end view is illustrated in FIG. 2. However, the member 30 may be prefabricated to have a curved shape in the so-called vertical plane as indicated in FIGS. 3 and 4 wherein, in FIG. 3, a railing member 30*a* is illustrated wherein the part 34 has been fabricated into a somewhat concave curved shape, as shown. In FIG. 4, a modified railing member or baluster 30*b* is shown wherein the part 34 has been fabricated in a somewhat convex curved shape in the opposite direction. In this way, a railing system may be made up of members 30, 30*a* and 30*b* having a repeating ornamental pattern and adapted for straight and curved runs of the railing system for both balcony and stairway railings. It has been determined that a radius of curvature for the members 30*a* and 30*b* of about forty-eight inches is suitable for most applications of curved balconies or stairways.

Although the railing member 30, as well as the other railing members to be described herein, may be formed of wrought iron or other wrought metals, the members may also be formed of cast metal or other materials meeting the strength requirements of conventional handrailing systems used in public and private buildings or bordering any area requiring or desirably having a railing or barrier structure.

Figure 5:
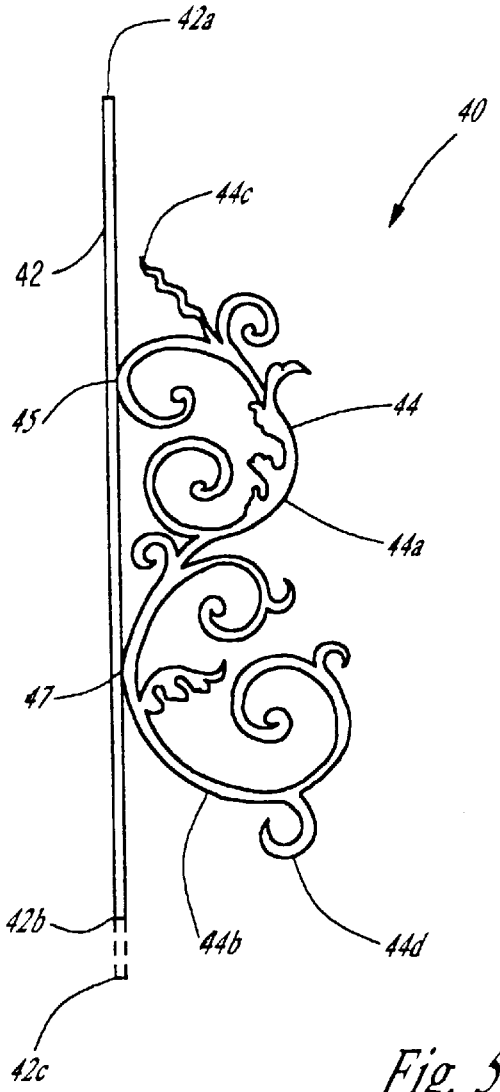
FIG. 5 is a side elevation of another railing member in accordance with the present invention.

Referring now to FIG. 5, another railing member or baluster in accordance with the invention is illustrated and generally designated by the numeral 40. The baluster 40 is also characterized by an elongated vertically extending rodlike stanchion 42 to which is secured an ornamental barrier part 44 extending laterally from one side of stanchion 42 and made up of one or more ornamental curved or shaped portions 44*a* and 44*b*, for example. The part 44 is suitably secured to the stanchion 42 by welding or mechanical fasteners at securement points 45 and 47. The length of the stanchion 42 with respect to the uppermost extending portion 44*c* or the lowermost extending portion 44*d* of the part 44 may vary. The stanchion 42 may be of the length shown by the solid lines in FIG. 5 or the distal ends 42*a* and 42*b* of stanchion 42 may be extended as indicated by an extension portion 42*c* in FIG. 5. In fact, with regard to all of the railing members or balusters shown and described herein, the stanchion of the baluster may be of a predetermined length when manufactured and then cut at one or both ends to a prescribed or desired length when utilizing these railing members in a particular railing system, such as one of those to be described further herein and shown in the accompanying drawings.

Figure 6:
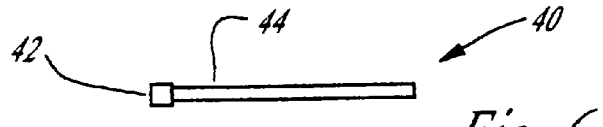
FIG. 6 is a top plan view of the railing member shown in FIG. 5.
Figure 7:
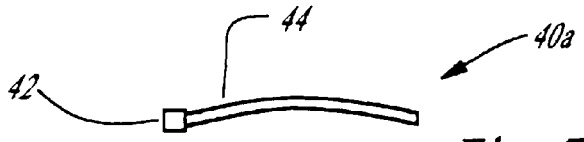
FIG. 7 is a top plan view of an alternate embodiment of the railing member shown in FIG. 5 having a somewhat concave curved configuration.
Figure 8:
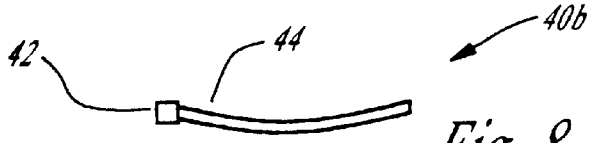
FIG. 8 is a top plan view of another embodiment of the railing member shown in FIG. 5 and having a somewhat convex curved configuration.

The baluster 40 is also a generally planar member, as shown in FIG. 6, and the stanchion 42 and ornamental part 44 may be formed of the same material and approximately the same dimensions as described above for the baluster 30. However, modified baluster members 40*a* and 40*b* may be provided as prefabricated members, as shown in FIGS. 7 and 8, wherein the barrier part 44 may be curved in one direction or the other, as shown, for use with curved balconies or stairways, respectively.

Figure 10:
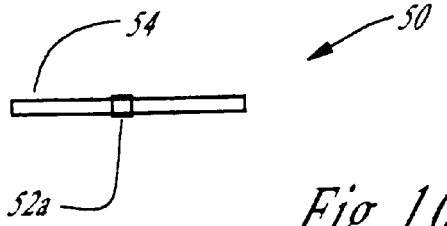
FIG. 10 is a top plan view of the railing member shown in FIG. 9.
Figure 11:
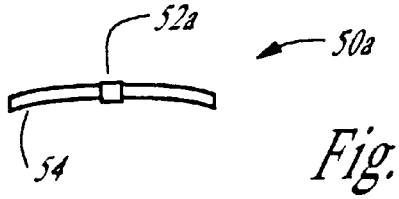
FIG. 11 is a top plan view of an alternate embodiment of the railing member shown in FIG. 9 and having a somewhat concave curved configuration.
Figure 12:
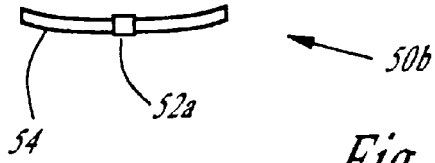
FIG. 12 is a top plan view of another embodiment of the railing member shown in FIG. 9 having a somewhat convex curved configuration.
Figure 9:
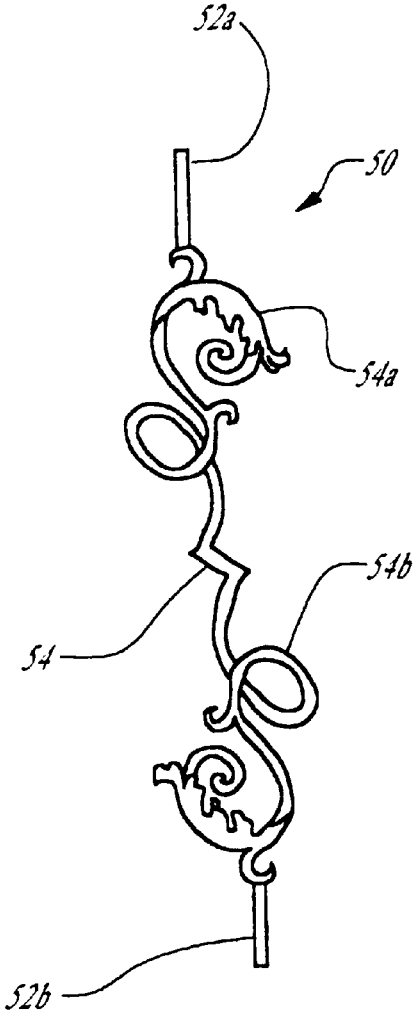
FIG. 9 is a side elevation of a third railing member in accordance with the present invention.

Referring now to FIGS. 9 and 10, yet another railing baluster in accordance with the invention, is illustrated and generally designated by the numeral 50. The baluster 50 includes opposed, generally co-planar and coaxial stanchion parts 52*a* and 52*b* which are formed integral with or suitably connected to opposite ends of an ornamental barrier part 54 having ornamental curved portions 54*a* and 54*b*, respectively. As shown in FIG. 10, the baluster 50 may also be a generally planar member when viewed from an end or side and is preferably formed of the same materials and having the same approximate component dimensions as the balusters 30 and 40. However, modified balusters 50*a* and 50*b* may also be fabricated, as shown in FIGS. 11 and 12, wherein the barrier part 54 is curved in one direction or the other to form a so-called concave or convex baluster. A baluster, such as the baluster 50, may not require to be provided as a concave or convex curved member, depending on the width of the barrier part 54.

Figure 13:
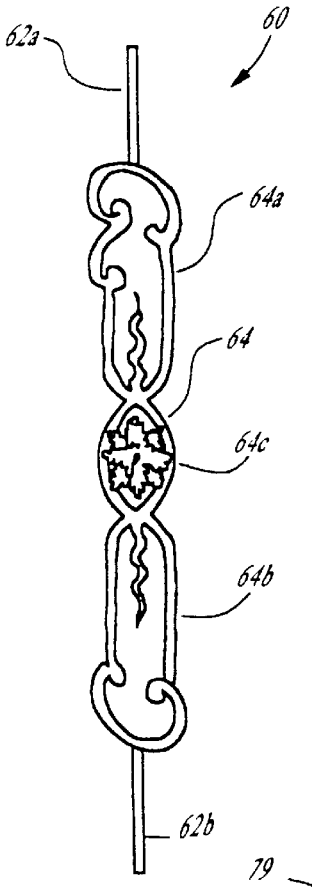
FIG. 13 is a side elevation of a fourth railing member in accordance with the invention.
Figure 14:
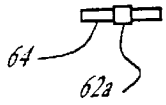
FIG. 14 is a top plan view of the railing member shown in FIG. 13.

Another embodiment of a railing baluster in accordance with the invention, is illustrated in FIGS. 13 and 14 wherein the width and configuration of the baluster member 60 is such that the baluster may not require modification to provide a convex or concave shape. Railing member or baluster 60 is similar in some respects to the baluster 50 and is characterized by opposed, generally coaxial stanchion parts 62*a* and 62*b*, which are integrally formed with or suitably secured to a barrier part 64 having somewhat closed loop scroll portions 64*a* and 64*b* and a central connecting portion 64*c*. The baluster 60 may also be formed of wrought or cast iron, other metals or non-metallic compositions, if sufficient strength can be obtained to serve in a barrier type railing system for stairways or balconies, for example.

Stairway or balcony railing systems utilizing the balusters 30 40, 50 and 60 may be constructed wherein the height of the balusters, excluding a top, generally horizontal handrail, may range from about thirty inches to forty inches, for example. The balusters 30 and 60 may be arranged side-by-side in predetermined repetitive patterns to form a continuous railing system over the required length for a balcony and the balusters 40, 50 and 60 may be arranged in predetermined patterns for stairways, as shown.

Figure 15:
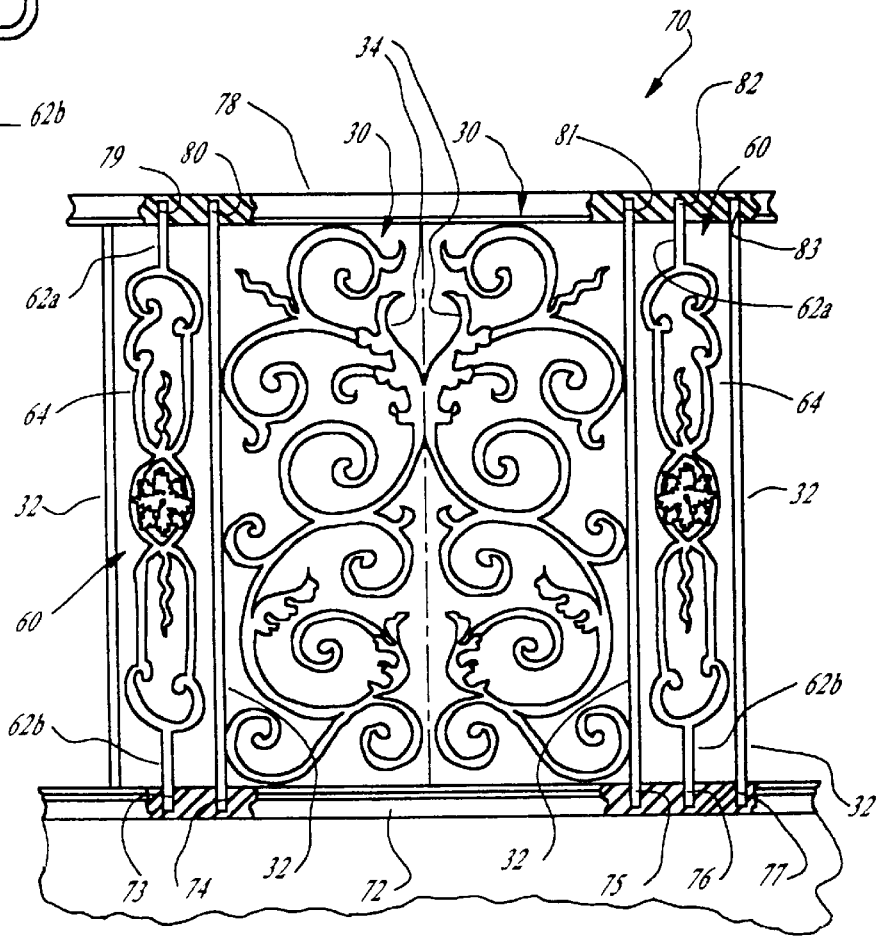
FIG. 15 is a side elevation of a portion of a generally horizontal balcony railing utilizing only two of the railing members of the present invention arranged in a repetitive pattern to provide an ornamental protective railing.

An example of a substantially horizontal balcony railing system is illustrated in FIG. 15. Referring to FIG. 15, a portion of a railing system 70 is illustrated wherein a floor or lower rail member 72 is provided and may be formed of wood or other material and is provided with suitable spaced apart drilled holes or bores 73, 74, 75, 76 and 77, for example, for receiving the stanchions of respective side-by-side closely spaced apart balusters 60, 30, 30 and 60, as shown, or by using balusters 60, 30*a*, 30*b*, 60 in a pattern for a curved balcony. Stanchions 32 for third and fourth balusters 30 are illustrated. Viewing FIG. 15 from left to right, the first balusters 60 and 30 are facing in one direction and the second balusters 30 and 60 are facing in the opposite direction to provide a predetermined ornamental pattern of the railing system 70. The balusters 30 and 60 are also connected to a generally horizontally extending elongated handrail 78 which is provided with suitable spaced apart bores 79, 80, 81, 82 and 83, as shown, for receiving the stanchion 62*a* and the opposite ends of the stanchions 32 of the respective balusters 60 and 30. The handrail 78 may be formed of wood or other suitable material and the bores formed in the base member or floor 72 and the handrail 78 may be cylindrical drilled holes which are then suitably formed to receive the square cross section shape of the stanchions 32 and the stanchions 62*a* and 62*b*.

Those skilled in the art will appreciate that the railing system 70 may be provided with plural ones of balusters 30 and 60 arranged in a predetermined pattern which repeats itself, as desired, throughout the required length of the railing system. The modular construction of the railing system utilizing the separate balusters with their respective rodlike stanchions and ornamental barrier parts provides for constructing railing systems having various ornamental patterns, which railing systems may be constructed on site and the respective balusters selected for a particular railing system may be easily pre-ordered and erected at the site of installation of the railing system. The bores for receiving the stanchions of the respective balusters 30 and 60 may be easily predetermined as to their location on the bottom rail or floor 72, as well as on the top handrail 78. Moreover, the barrier parts 34 and 64 for each of the balusters 30 and 60 are proportioned such that, when erected with a floor or base rail member 72 and a handrail 78 and when disposed adjacent each other, provide a barrier to the passage of an object of a predetermined dimension. For example, many building codes and the requirements of other regulatory bodies are such that the barrier parts of a railing system must be dimensioned in a way which will not allow an object of a certain dimension to pass therethrough. Barrier parts which prohibit pass-through of an object of a minimum dimension, such as a four inch diameter ball or cylinder, for example, is a common requirement. The barrier parts of the balusters 30 and 60 meet such a requirement when erected in a railing system such as the railing system 70.

Figure 16:
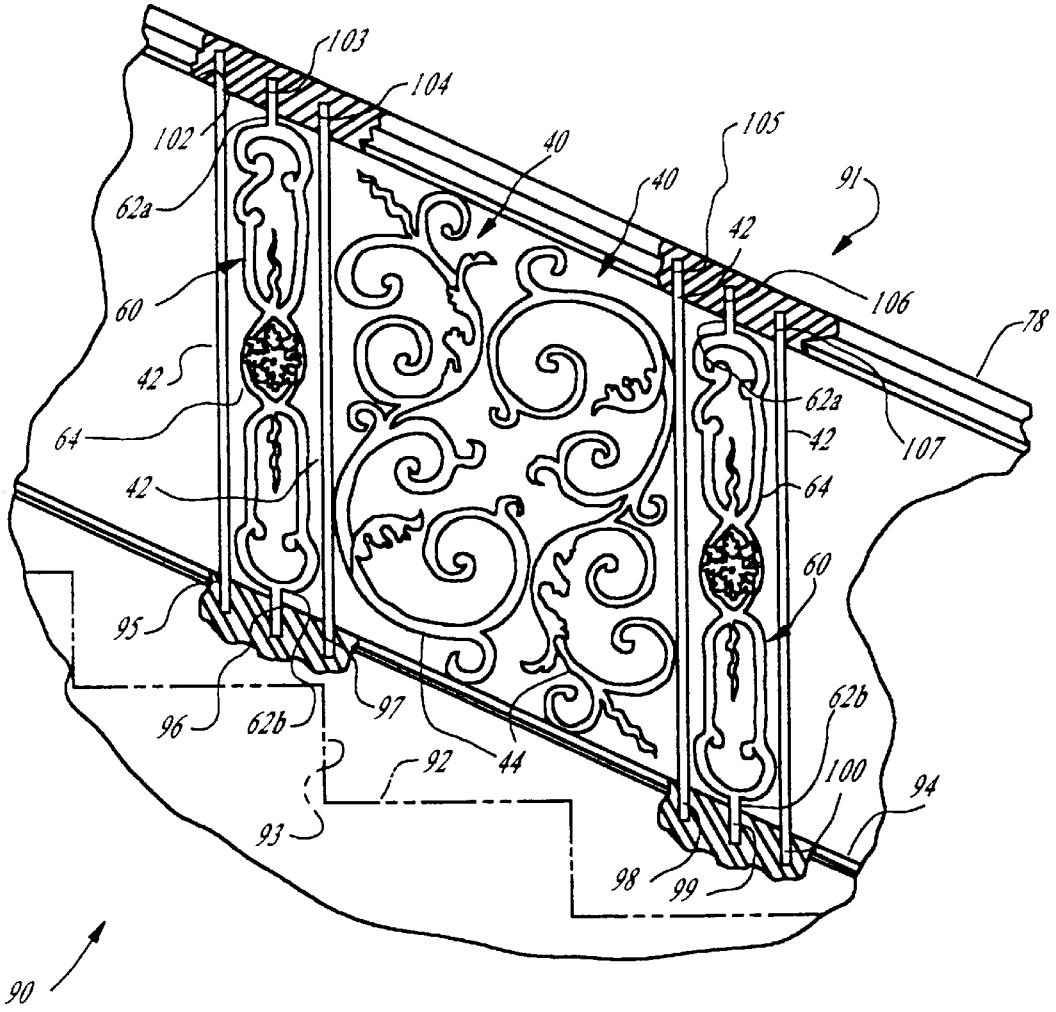
FIG. 16 is a side elevation of a portion of a stairway railing system in accordance with the invention.

Referring now to FIG. 16, there is shown a portion of a stairway 90 having treads 92 and risers 93 and a vertical wall portion disposed along one side of the stairway and generally designated by the numeral 94. The wall portion 94 is commonly known as a closed stringer and may be constructed of wood or other suitable materials of suitable thickness. As shown in FIG. 16, the stringer 94 is provided with suitable spaced apart bores 95, 96, 97, 98, 99 and 100 for receiving the stanchions 42 and 62*b* of the respective balusters 60 and 40 making up a stairway railing system 91. The stairway railing system 91 also utilizes a top handrail 78 which has respective bores formed therein and designated by the numerals 102, 103, 104, 105, 106 and 107, for example, for receiving the opposite ends of the respective stanchions 42 and 62*a* of the respective balusters 40 and 60 as shown.

In the ornamental railing system 91, a repeating pattern is provided comprising a baluster 60, a first baluster 40 in an upright position and a second adjacent baluster 40 in an inverted position. This pattern may be repeated, as needed, throughout the length of the stairway 90. Balusters 40*a* and 40*b* would, of course, be used in place of balusters 40 if the stairway was curved. Thanks to the configuration of the barrier parts 44 of the balusters 40, the railing system 91 is also in accordance with the requirements for providing a suitable barrier to the pass-through of an article having more than a four inch maximum dimension. One advantage of the configuration of the baluster 40, including the vertical rod-like stanchion 42 and the scroll-like barrier part 44, is that stairway slope (that is, the acute angle with respect to a horizontal floor or stair tread 92) may vary substantially, without requiring modification of the balusters, except for possibly cutting the stanchion parts 42 and 62*a*, 62*b*, for example, to a length such that the barrier parts 44 and 64 will be disposed sufficiently close to the stringer 94 and the rail 78 to meet the barrier pass-through requirements. As mentioned previously, each of the balusters of the railing system of the invention may have stanchion parts which may be easily prefabricated to a predetermined length and then cut to a requisite shorter length during assembly of the railing system, for example.

Figure 17:
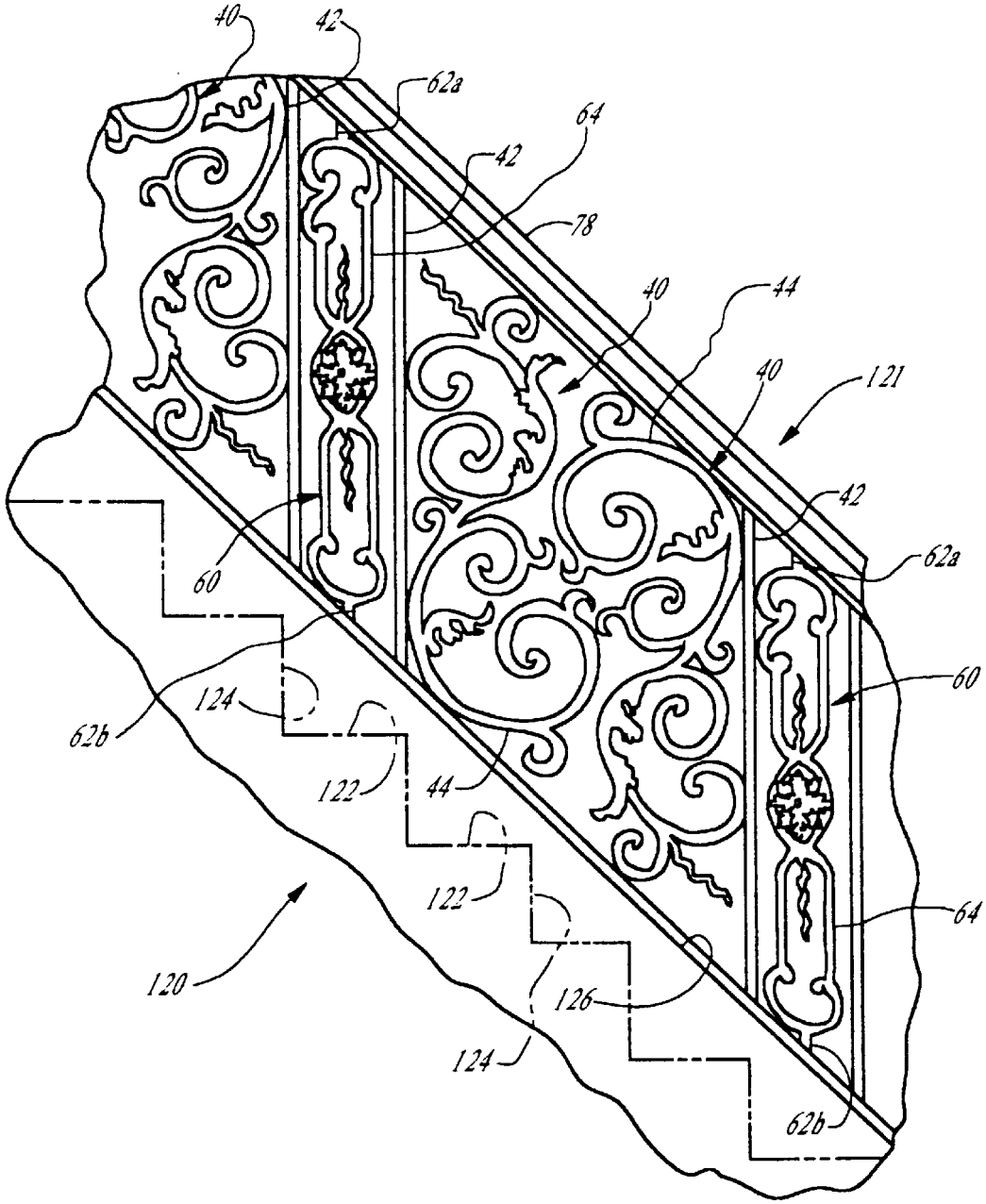
FIG. 17 is a side elevation of a portion of a stairway railing system in accordance with the invention and having a steeper slope than the system shown in FIG. 16.

By way of example and referring to FIG. 17, there is shown another stairway 120 having respective treads 122 and risers 124 and a closed support wall portion or stringer member 126 extending therealong and adapted to support a railing system 121 made up of railing members or balusters 40 and 60 in substantially the same pattern as for the stairway 91 and including a top handrail 78. However, the slope of the stairway 121 is substantially greater than the stairway 90. By way of example, the stairway 90 has a slope of approximately twenty-five degrees from the horizontal whereas the stairway 121 has a slope of about forty-five degrees to forty-eight degrees, for example. By merely providing bores in the riser 126 and the railing 78 of sufficient depth for receiving the stanchions 62*a*, 62*b* and 42, to provide minimal spacing between the stringer 126 and the handrail 78 with respect to the barrier parts 44 and 64, and/or cutting the stanchion parts at their distal ends, as required, the stairway 120 of significantly greater slope than the stairway 90, may also be provided with a railing system which utilizes the balusters 60 and 40, or 40*a* and 40*b* without further modification.

Figure 18:
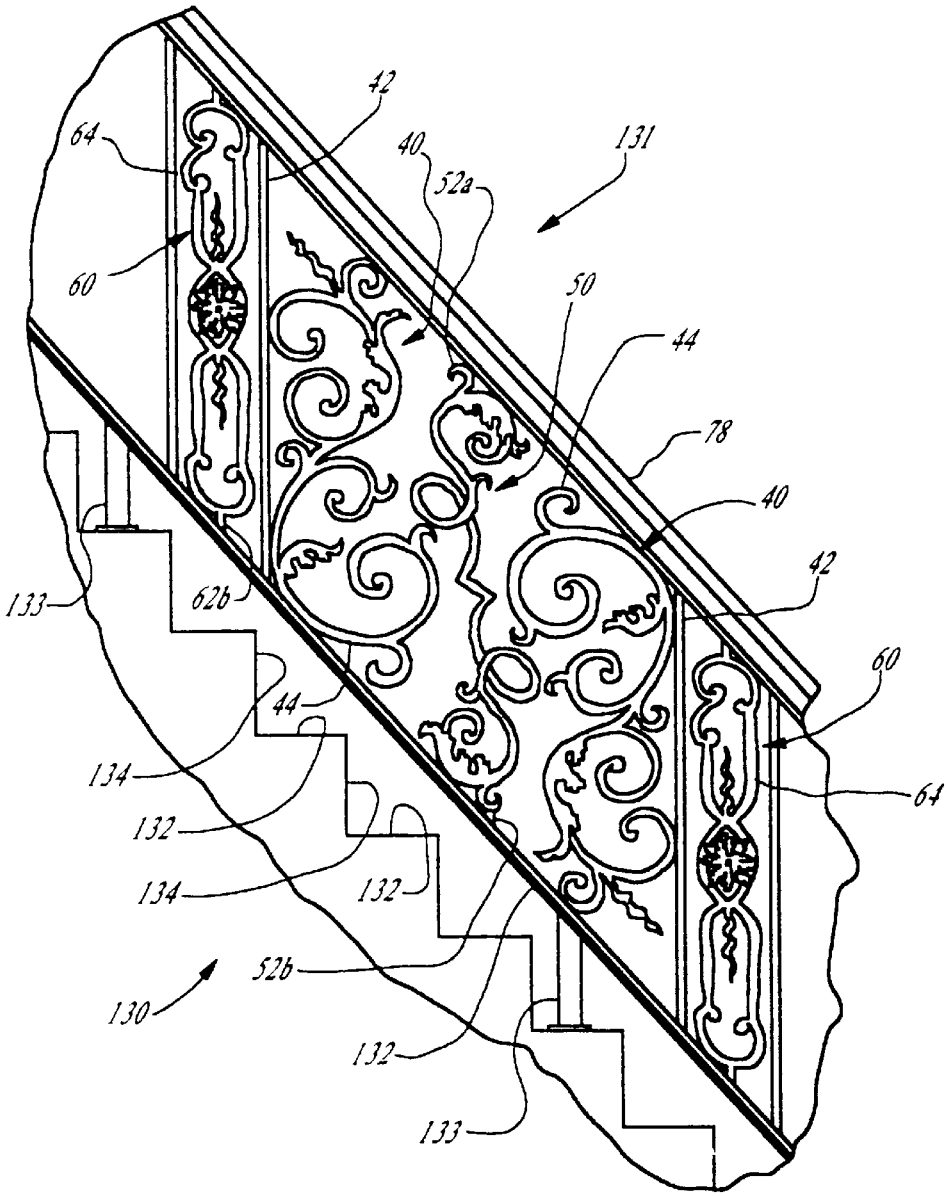
FIG. 18 is a side elevation of a portion of a stairway railing system in accordance with the invention and utilizing another pattern of railing members of the invention.

Referring now to FIG. 18, another stairway having a superior railing system in accordance with the invention is illustrated and generally designated by the numeral 130. The stairway 130 is configured with a so-called open stringer arrangement and includes treads 132 and risers 134. Since no side support or closed stringer is provided for the stairway 130, a railing system 131 in accordance with the invention, is provided by a bottom rail support member 132, a top handrail 78 spaced from and preferably parallel and coextensive with member 132, and a predetermined pattern of balusters 60, 40, 50 and 40, as shown in FIG. 18. The second baluster 40, viewing FIG. 18 left to right, is inverted with respect to the first baluster and the baluster 50 is interposed between the two balusters 40. This pattern may be repeated indefinitely or as required by the length of stairway 130. The bottom rail 132 may be a wood or metal beam and the lower distal ends of stanchions 42, 52*b* and 62*b* may be inserted in suitable bores in the bottom rail member 132 or welded thereto, if needed. Bottom rail 132 is supported by suitable bottom rail stanchions or support members 133 spaced apart along the bottom rail member 132 and supported on selected spaced apart treads 132, for example. Thus, the stairway 130 enjoys a railing system 131 which is made up of plural balusters 40, 50 and 60 arranged in a predetermined pattern which may be repeated, as needed, and the balusters may be assembled at the site of installation of the railing system 131 for various stairway slopes.

As previously mentioned, balusters in accordance with the invention may also be prefabricated to be curved out of a vertical plane such as illustrated for the members 30*a*, 30*b*, 40*a*, 40*b* and 50*a* and 50*b*, which may be used to construct curved balconies and stairways, respectively.

Figure 19:
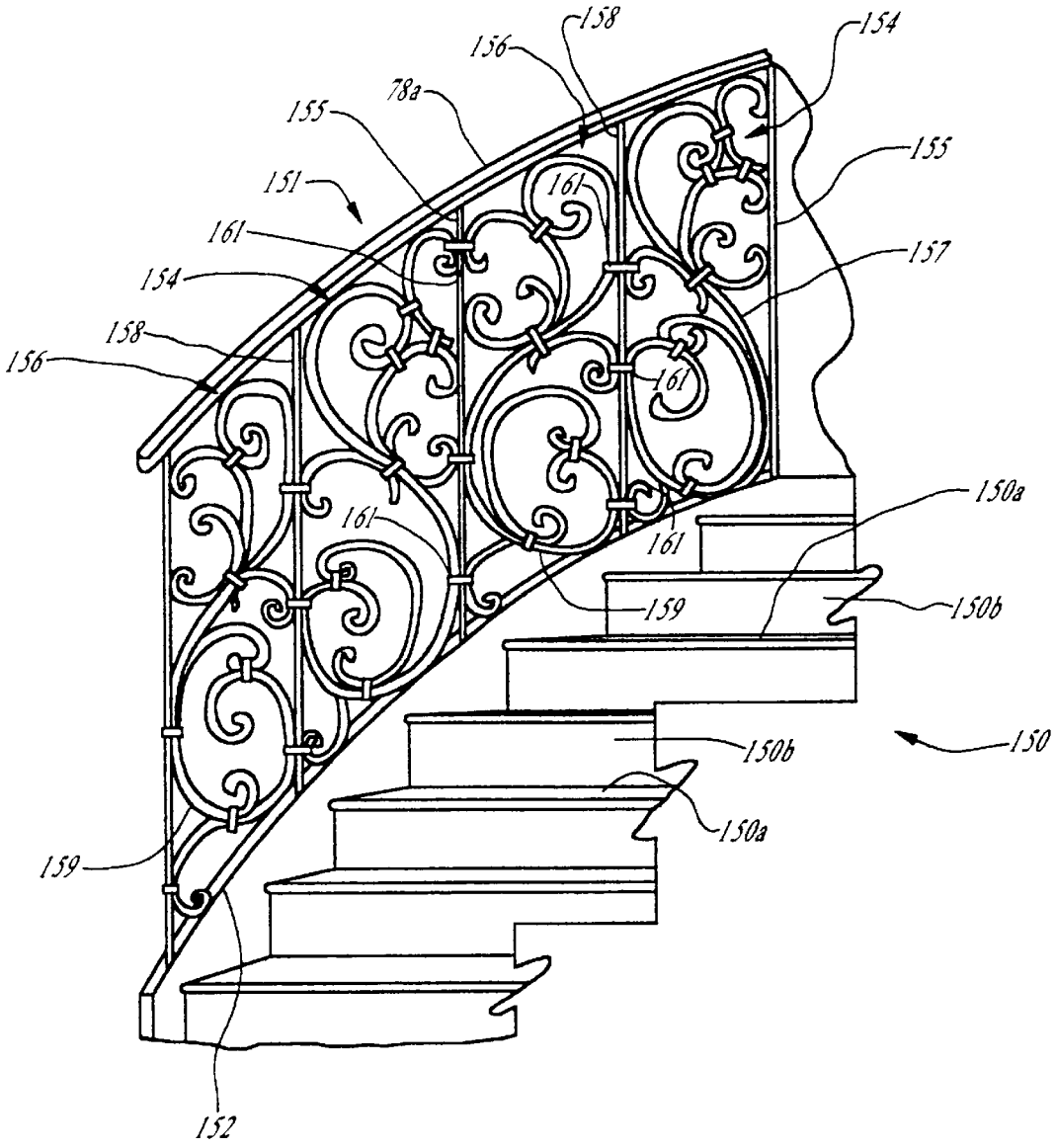
FIG. 19 is a perspective view of a curved stairway railing system in accordance with the invention.

Referring now to FIG. 19, a curved stairway 150 is shown having treads 150*a* and risers 150*b* and in which an outside closed stringer or support member 152 is provided for supporting a railing system 151. Railing system 151 includes a curved elongated handrail 78*a* and respective balusters 154 and 156, similar to the balusters 40, 40*a* and 40*b*, which are curved out of the vertical plane, respectively, and are arranged in a repeating pattern, as shown. Each baluster 154 includes an elongated rod-type stanchion 155 supporting a barrier part 157 extending laterally from one side thereof, and suitably secured thereto. Each baluster 156 includes a similar stanchion 158 and a barrier part 159 suitably secured thereto.

The barrier parts 157 and 159 are formed in such a way as to be of aesthetically pleasing ornamental appearance and to be contiguous with or in close proximity to the stringer 152 and the railing 78 and to the adjacent stanchions of the adjacent baluster members to provide the requisite minimum pass-through requirements.

The stanchions 155 and 158 are supported by the stringer 152 and connected to the handrail 78*a* in the same manner as the stanchions for the railing members or balusters 30, 40, 50 and 60, previously described. Thus, viewing FIG. 19, those skilled in the art will appreciate that railing members or balusters in accordance with a railing system of the present invention, may have different ornamental shapes or configurations. Moreover, adjacent balusters 154 and 156 may be secured to each other by welding or by ornamental connector members 161 at positions where the stanchion of one baluster is essentially contiguous with the barrier part of an adjacent baluster. Ornamental connectors may not normally be required for the railing system of the invention but can be desirable for aesthetic purposes, depending on the ornamental configuration of the respective balusters.

Figure 20:
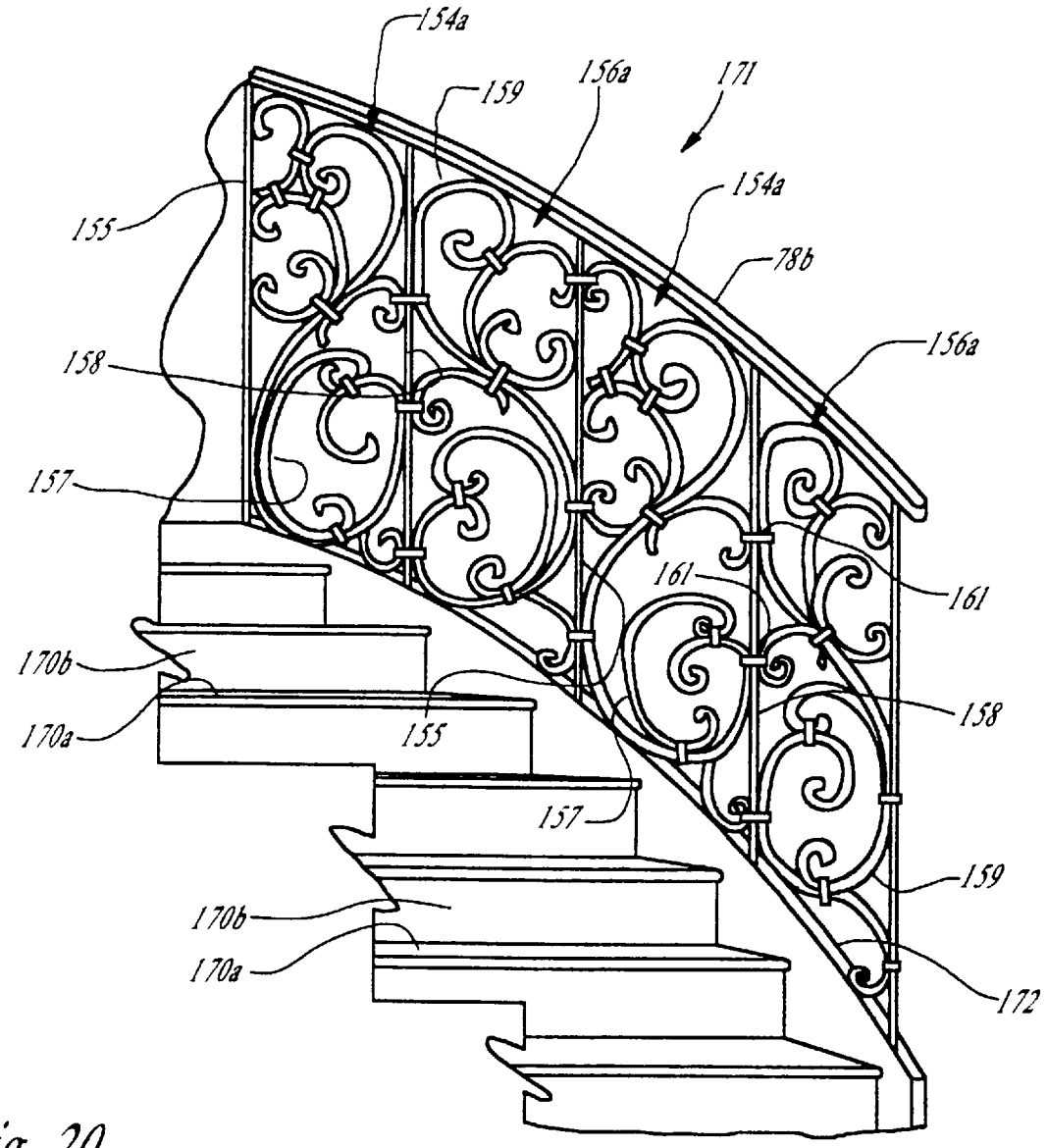
FIG. 20 is a perspective view of another curved stairway railing system in accordance with the invention.

FIG. 20 illustrates another stairway 170 comprising treads 170*a* and risers 170*b* and similar to the stairway 150, but curving in the opposite direction. Accordingly, a curved stringer 172 is operable to support a railing system 171 in accordance with the invention including a handrail section 78*b* of opposite curvature to the handrail section 78*a* and also including balusters 154*a* and 156*a* arranged in a repeating pattern like the stairway 151 but being curved in the opposite direction from a vertical plane.

The balusters 154, 156, 154*a* and 156*a*, as will as the balusters described herein below, may be formed of the same materials and having approximately the same proportions as the balusters 30, 40, 50 and 60, respectively. Moreover, by providing each of the balusters or railing members 30 and 40, or 154 and 156, and their counterparts which are not substantially planar in the vertical plane, to have a stanchion and a barrier part connected to and projecting laterally from the stanchion, a convenient modular railing system may be provided which is economical to manufacture, prestock or inventory, provides a custom appearance and may be easily constructed on the site of installation of the railing system.

Further embodiments of the invention which meet the stairway angle requirements and maximum pass-through dimension requirements previously discussed will now be described.

Figure 21:
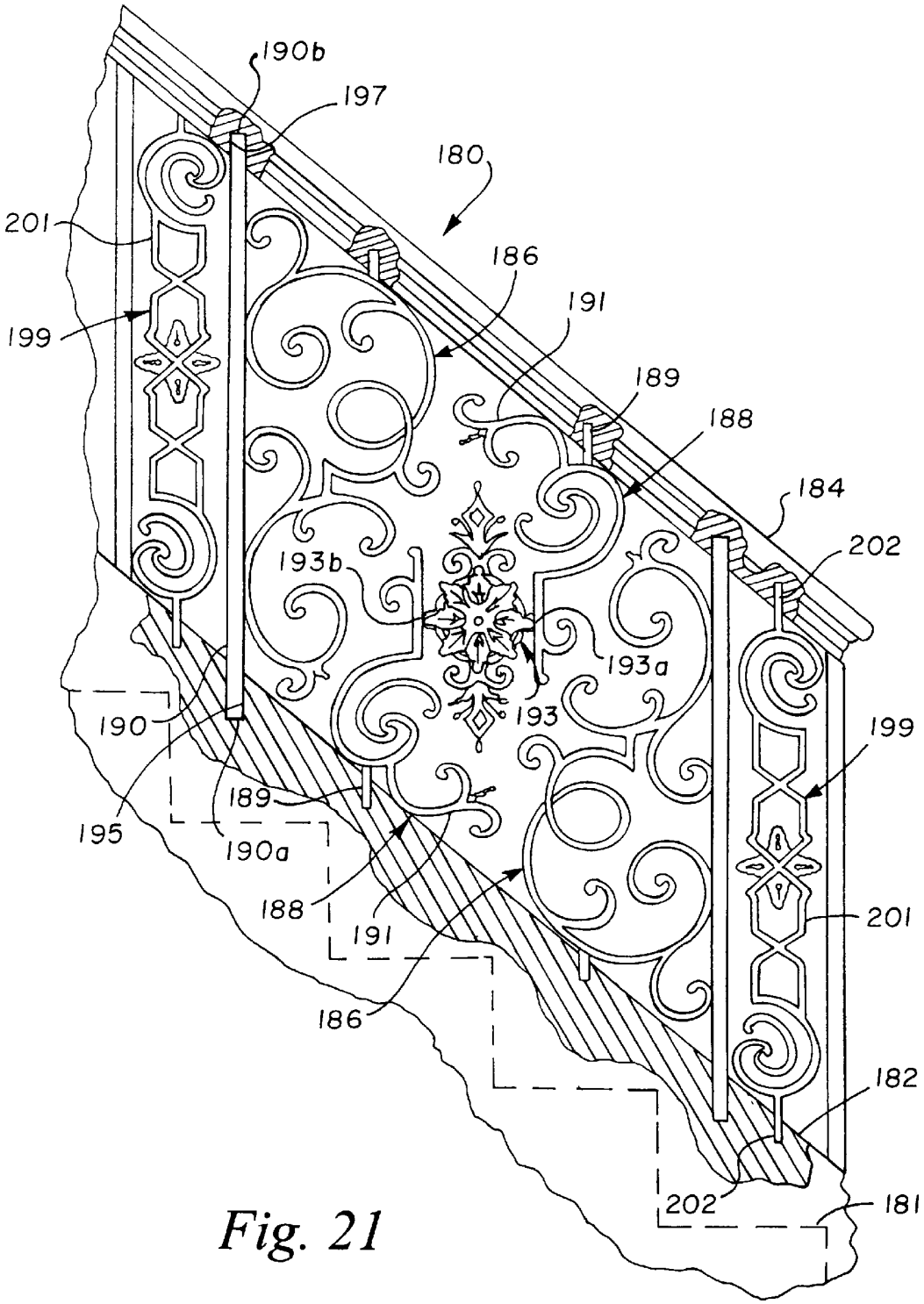
FIG. 21 is a side elevation, partially sectioned, of a further stairway railing system in accordance with the invention.

Referring to FIG. 21, another embodiment of a railing system in accordance with the invention is illustrated as a stairway railing 180 for a stairway 181 having a so-called closed stringer type base support member 182 and a handrail 184 spaced thereabove. The railing system 180 includes baluster members 186, 188 and 199 which are supported between the stringer 182 and the handrail 184 in generally the same manner as the embodiments previously described hereinabove.

Figure 22:
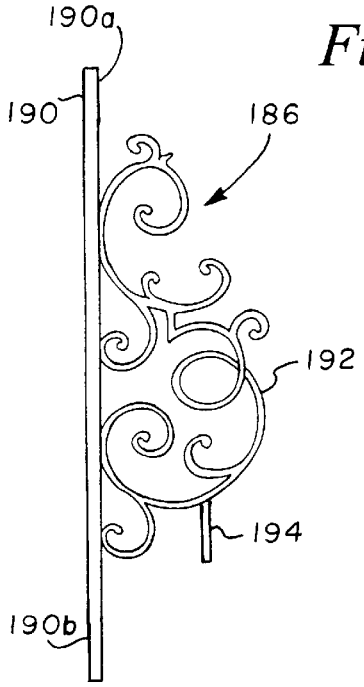
FIG. 22 is a side elevation of another embodiment of a railing member or baluster for use in the railing system of FIG. 21.
Figure 23:
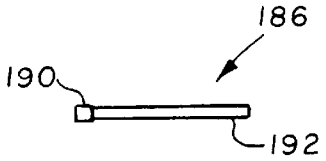
FIG. 23 is a top plan view of the baluster shown in FIG. 22.

Referring also to FIG. 22, each of the balusters 186 includes an elongated rodlike stanchion part 190 and an ornamental barrier part 192 extending laterally from one side of the stanchion part. However, each of the balusters 186 also includes a secondary stanchion part 194 comprising a relatively short rod connected to a portion of the ornamental barrier part 192 at a point spaced from the stanchion part 190 and extending generally parallel thereto. As indicated in FIG. 22, each stanchion part 190 includes opposed distal ends 190*a* and 190*b* which extend beyond the ornamental barrier part 192. FIG. 23 illustrates a top plan view of the baluster 186 indicating that the stanchion part 190 and the barrier part 192, as well as the stanchion part 194, are substantially coplanar.

Referring again to FIG. 21, it is indicated that each of the balusters 186 may be connected to the stringer 182 and the handrail 184 and supported thereby wherein the opposed stanchion ends 190*a* and 190*b* are suitably disposed in bores 195 and 197, for example, formed in the stringer and the handrail 184. As further shown in FIG. 21, the balusters 188 each include a rodlike stanchion part 189 and an ornamental barrier part 191. However, the stanchion parts 189 extend, from only one side of the ornamental barrier parts 191 and are disposed in bores formed in the stringer 182 and the handrail 184, respectively. A further ornamental barrier part 193 is provided for the railing system 180 and is suitably secured to the balusters 188 at opposed trunnions 193*a* and 193*b* by mechanical fasteners or by welding, as desired. The balusters 199 also include ornamental barrier parts 201 and opposed rodlike stanchion parts 202 which are substantially co-axial with each other and also fit in corresponding bores in the stringer 182 and the handrail 184.

Figure 24:
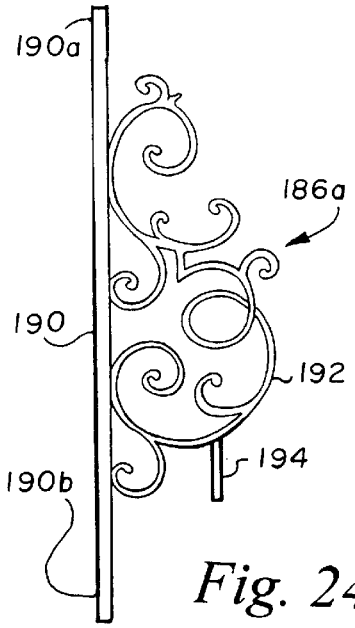
FIG. 24 is a side elevation of a curved baluster for use in a balcony or a railing system similar to that shown in FIG. 21.
Figure 25:
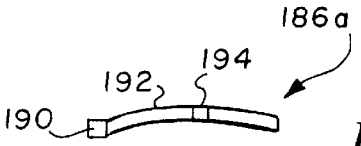
FIG. 25 is a bottom plan view of the baluster shown in FIG. 24.
Figure 26:
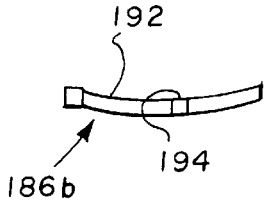
FIG. 26 is a bottom plan view of a baluster substantially like the baluster of FIGS. 24 and 25 but curved in the opposite direction.

Referring briefly to FIGS. 24 through 26, the baluster 186 may be modified to form a baluster 186*a*, FIGS. 24 and 25, or 186*b*, FIG. 26 and the ornamental barrier part may be formed to have a radius of curvature approximately the same as for the balusters mentioned previously herein, so that a railing system for a curved balcony or stairway may also be provided and made up of balusters 186*a*, 186*b*, 188 and 199. In order to accomplish the prescribed radius of curvature of virtually any curved stairway only the balusters 186 need be modified, in most instances, to be either concave or convex. By way of definition the baluster 186*a* is concave and the baluster 186*b* is convex. If desired the balusters 188 can also be formed to have substantially the same radius of curvature as the barrier parts 192 of the balusters 186*a* and 186*b*. Thanks to the configuration of the railing system 180, including the balusters 186, 188, 193 and 199, horizontal balcony railings may be formed or stairway railings may be formed having a slope of between about 25° to 50° while forming a continuous barrier to pass-through of an object comprising a ball or sphere having a predetermined diameter of about four inches, in order to comply with safety codes. Moreover, if a curved balcony or stairway railing is required then the balusters 186 may be replaced by balusters 186*a* and/or 186*b* and the balusters 188 and 199 may be formed to have the same radius of curvature of the balusters 186*a* and 186*b*, if desired.

Figure 27:
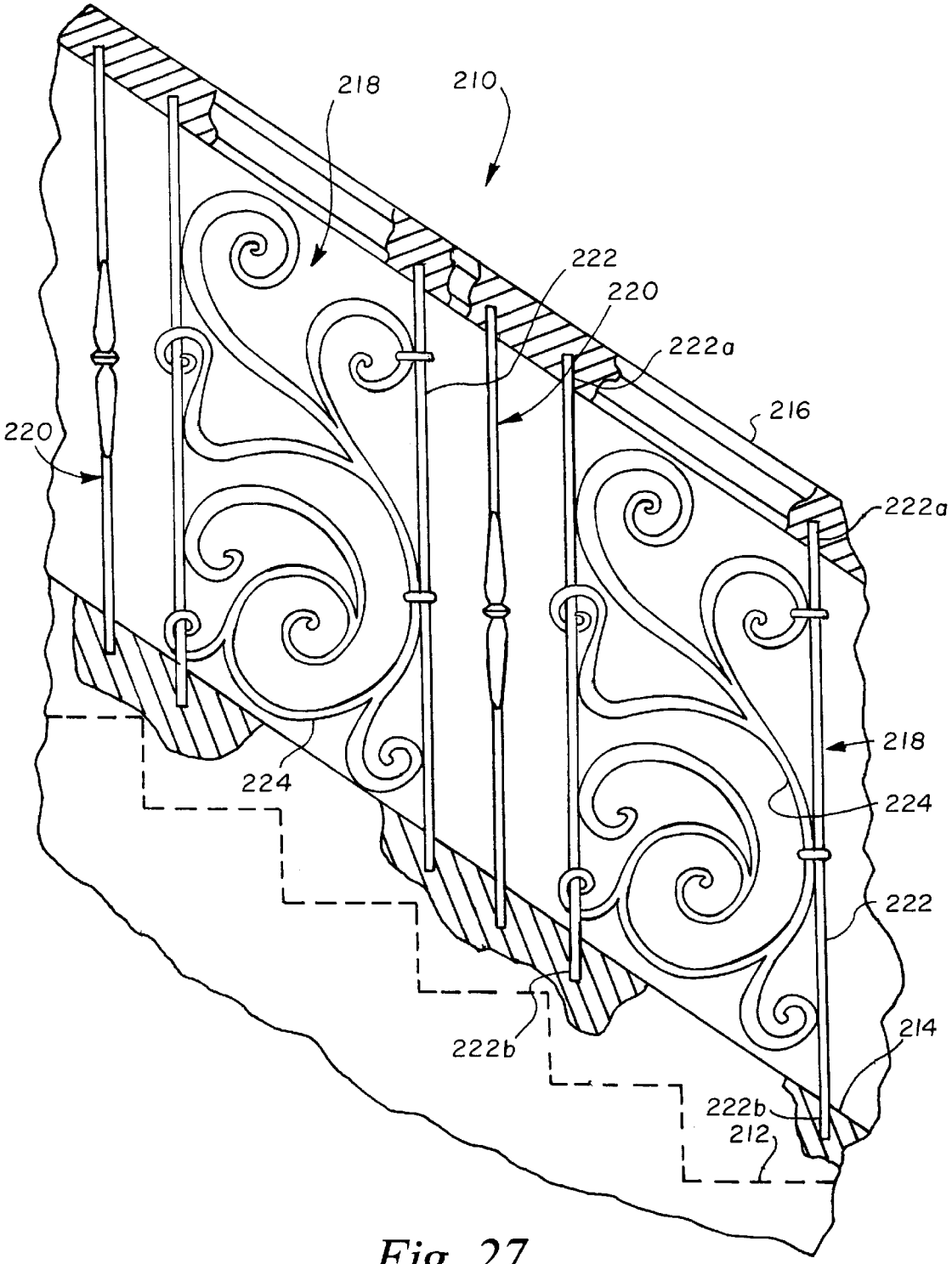
FIG. 27 is a side elevation of still another railing system in accordance with the invention.
Figure 28:
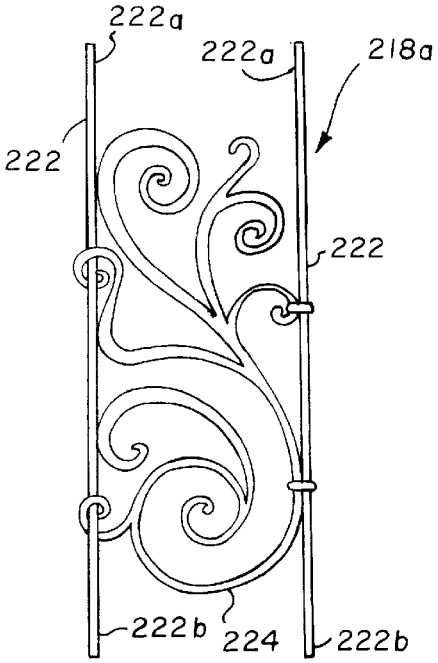
FIG. 28 is a side elevation of a baluster for use in a railing system such as shown in FIG. 27 but primarily for use with horizontal balcony railings.
Figure 32:
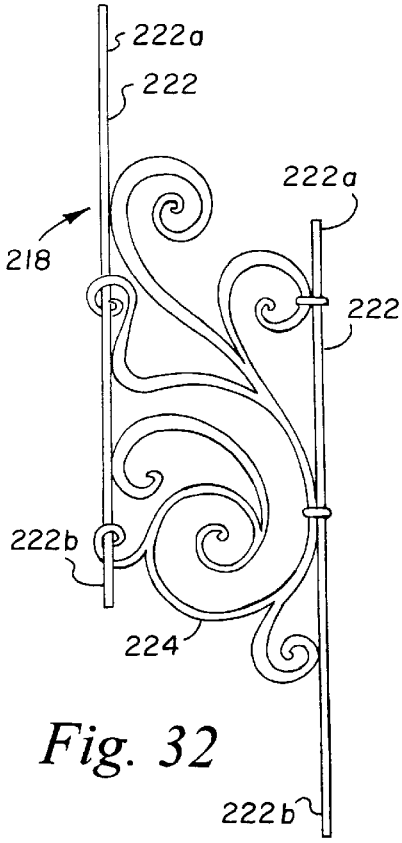
FIG. 32 is a side elevation of one of the balusters shown in the railing system of FIG. 27.

Referring now to FIG. 27, yet another embodiment of a railing system in accordance with the invention is illustrated and generally designated by the numeral 210. The railing system 210 is shown configured for a straight stairway 212 having a closed stringer type base support member 214 and a handrail 216 spaced therefrom and connected to spaced apart balusters 218 and 220. Unlike most of the previous embodiments described hereinabove, the balusters 218, see FIG. 32 also, comprise two spaced apart generally rodlike stanchion parts 222 suitably secured, such as by welding or by suitable fastener means, to an ornamental barrier part 224. For applications in stairway railings the baluster 218 is configured such that the rodlike stanchion parts are parallel to each other and coplanar but are axially offset from each other, as illustrated in FIGS. 27 and 32, in sufficient amount to allow the baluster 218 to be used in stairways having slopes within the ranges heretofore mentioned, i.e., 25° to approximately 50°. Alternatively, if a baluster 218 is to be used as a baluster for a generally horizontal balcony railing then the baluster 218 may be modified as shown in FIG. 28 to comprise a baluster 218*a* wherein the stanchion parts 222 are supported side-by-side and are coextensive with each other.

Figure 29:
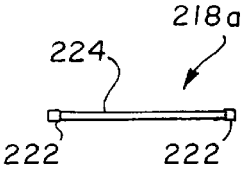
FIG. 29 is a top plan view of the baluster shown in FIG. 28.
Figure 30:
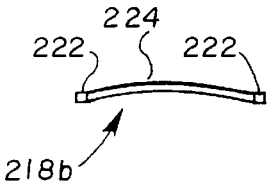
FIG. 30 is a top plan view of a modified baluster similar to that shown in FIG. 28 but curved in one direction.
Figure 31:
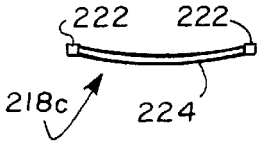
FIG. 31 is a top plan view of a baluster similar to that shown in FIG. 28 but curved in an opposite direction.
Figure 33:
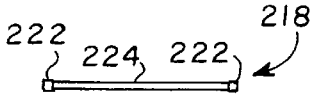
FIG. 33 is a top plan view of the baluster shown in FIG. 32.
Figure 34:
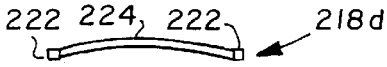
FIG. 34 is a top plan view of a baluster similar to that shown in FIG. 32 but curved in one direction.
Figure 35:
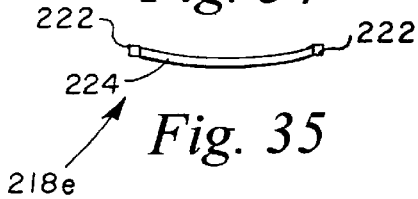
FIG. 35 is a top plan view of a baluster similar to that shown in FIG. 32 but curved in the opposite direction.

As shown in FIG. 29, the baluster 218*a* is configured such that the stanchion parts 222 and the barrier part 224 are coplanar. However, the baluster 218*a* may be modified to comprise a baluster 218*b* wherein the barrier part 224 is curved out of a plane containing the stanchion parts 222 and has the same radius of curvature as mentioned hereinabove for the other balusters of the invention to form a so-called concave baluster. Alternatively, if the barrier part 224 is curved in the opposite direction, a baluster 218*c* is formed, see FIG. 31, which is a so-called convex version of the baluster. Still further, viewing FIGS. 33 through 35, the baluster 218 has coplanar parts 222 and 224 but concave and convex versions 218*d* and 218*e* may be formed in the same manner as the formation of the balusters 218*b* and 218*c*.

Referring again briefly to FIG. 27, the stairway railing system 210 is made up of parallel spaced apart balusters 218 wherein the opposed distal ends 222*a* and 222*b* of each of the stanchion parts 222 are disposed in suitable bores formed in the stringer 214 and the handrail 216 in the same manner as for the previous embodiments. Substantially rodlike stanchion balusters 220 may be interposed between each of the balusters 218 to provide a desirable ornamental pattern, as indicated, with each of the opposite ends of the rodlike stanchion parts of balusters 220 also being disposed in suitable bores, as shown, formed in the stringer 214 and the handrail 216. Of course, if the stairway 212 was curved, the balusters 218 would be replaced by balusters 218*d* or 218*e*, and if a horizontal balcony railing was constructed having a curvature thereto, the baluster 218*a* would be replaced by spaced apart ones of balusters 218*b* or 218*c*, as required. Even though the balusters 218 and 218*a* through 218*e* utilize two spaced apart rodlike stanchion members 222 suitably connected to an ornamental barrier part 224, balcony or stairway railing systems utilizing balusters so constructed enjoy all of the advantages of the invention as with the previous embodiments.

The embodiments of the invention described in conjunction with FIGS. 22 through 35 may be fabricated of the same materials and in the same manner as the previously described embodiments and are also operable to form balcony or stairways railings having repeating ornamental patters and meeting the dimensional requisites previously described.

Those skilled in the art will appreciate from the foregoing description that a balcony and stairway railing system has been provided which may be easily prefabricated of a minimum number of parts which may be arranged to provide a functional and aesthetically pleasing railing system. The parts of the railing system are constructed in such a way that railing systems for straight and curved balconies and stairways may be easily constructed regardless of the radius of curvature of a balcony or a stairway which is likely to be suitable for any structure and regardless of the slope of a stairway which is normally constructed for commercial or residential building exterior or interior stairways.

By providing balusters, each with at least one stanchion part and a barrier part extending laterally therefrom, and which may be formed in a planar or curved configuration wherein the radius of curvature of the curved balusters is preferably about 48 inches, the overall width of the balusters 30, 40, 154, 156, 186, 86*a*, 186*b*, 188, 218, and 218*a* through 218*e* is in a range of from about 10 inches to 12 inches. The overall height of the barrier parts of the balusters is also preferably between 30 and 40 inches, such that a railing system may be constructed for a wide range of balcony and stairway configurations while preserving a uniform appearance and a particular style or "look" regardless of the particular geometry of the balcony or stairway.

Although preferred embodiments of the invention have been described in detail herein, those skilled in the art will further appreciate that various modifications and substitutions may be made to the railing members or balusters and the railing systems provided thereby without departing from the scope and spirit of the invention as recited in the appended claims.

What is claimed is:

1. A railing system for use as a stairway and a balcony having an elongated base support member and an elongated handrail adapted to be supported spaced from and above said base support member, said railing system comprising:

a plurality of spaced apart first balusters supported on said base support member and connected to said handrail, each of said first balusters having a single generally vertically extending rodlike stanchion part having opposed ends operable to be supported by said base support member and said handrail, respectively, and a barrier part having a predetermined ornamental shape connected to said single stanchion part and extending laterally from said single stanchion part, said barrier parts of said first balusters being of an ornamental shape such as to provide a predetermined ornamental pattern when arranged as a balcony railing and as a stairway railing, and said barrier parts each being curved out of a plane containing respective ones of said single stanchion part at a predetermined radius of curvature for forming one of a generally horizontally curved balcony railing and a curved stairway railing while forming a continuous barrier to pass-through of an object comprising a ball having a predetermined diameter of about four inches.

2. The railing system set forth in claim 1 wherein:

said first balusters comprise a second stanchion part spaced from said single stanchion part and connected to said barrier part and supported by only one of said handrail and said base support member.

3. The railing system set forth in claim 2 wherein:

said second stanchion part is insertable in a bore in only one of said base support member and said handrail.

4. The railing system set forth in claim 2 wherein:

said single and second stanchion parts are offset from each other in a longitudinal direction of said single and second stanchion parts.

5. The railing system set forth in claim 1 including:

spaced apart second balusters each comprising a single rodlike stanchion part and a barrier part, said single rodlike stanchion parts of said second balusters extending from one side of said barrier parts of said second balusters, respectively, and being operable to be supported by only one of said base support member and said handrail, respectively.

6. The railing system set forth in claim 5 including:

a pair of said second balusters spaced apart vertically with their respective rodlike stanchion parts supported by said base support member and said handrail, respectively.

7. A modular stairway railing system for a stairway including an elongated base support member extending along said stairway and providing a predetermined slope of said stairway of between about 25° to 50° with respect to a horizontal tread of said stairway, and an elongated handrail adapted to be supported spaced from and above said base support member, said railing system comprising:

a plurality of balusters supported on said base support member spaced apart from each other and extending between said base support member and said handrail, at least selected ones of said balusters each comprising a first vertically extending, elongated rod stanchion part having opposed distal ends supported on said base support member and connected to said handrail, respectively, and an ornamental barrier part comprising plural curved scroll-like portions connected to said first stanchion part and between said distal ends of said first stanchion part and extending laterally from only one side of said first stanchion part, a second stanchion part connected to said barrier part and spaced from said first stanchion part, said second stanchion part being operable to be supported by only one of said base support member and said handrail, said scroll-like portions of said barrier part of one baluster being shaped to cooperate with corresponding curved scroll-like portions of said barrier part of an adjacent baluster, said handrail and said one baluster, said plurality of balusters being spaced apart along said base support member at predetermined distances from each other and adjacent to each other to provide a predetermined ornamental pattern and to provide a protective barrier for said stairway having a predetermined maximum pass-through dimension for said railing system of an object comprising a ball having a diameter of about four inches.

8. The stairway railing system set forth in claim 7 wherein:

said selected ones of said balusters are disposed in said railing system in pairs of balusters wherein one baluster of a pair is inverted with respect to another baluster of a pair.

9. The stairway railing system set forth in claim 7 wherein:

said base support member comprises a closed stringer structure of said stairway.

10. A railing system for use as a stairway and a balcony having an elongated base support member and an elongated handrail adapted to be supported spaced from and above said base support member, said railing system comprising:

a plurality of spaced apart first balusters supported on said base support member and connected to said handrail, each of said first balusters having at least a first, generally vertically extending rodlike stanchion part having opposed ends insertable in corresponding bores in said base support member and said handrail, respectively, and a barrier part having a predetermined ornamental shape connected to said first stanchion part and extending laterally from said first stanchion part, said barrier parts of said first balusters being of an ornamental shape such as to provide a predetermined ornamental pattern when arranged as a balcony railing and as a stairway railing, spaced apart second balusters each comprising a single rodlike stanchion part and a barrier part, said single rodlike stanchion part extending from one side of said barrier part of each of said second balusters, respectively, and being insertable in a bore in only one of said base support member and said handrail, respectively, a pair of said second balusters spaced apart vertically with their respective rodlike stanchion parts inserted in said base support member and said handrail, respectively, and an ornamental barrier part disposed between said pair of said second balusters and connected to each of said second blusters, respectively, and said barrier parts of said first balusters being curved out of a plane containing said first stanchion part at a predetermined radius of curvature for forming one of a generally horizontally curved balcony railing and a curved stairway railing while forming a continuous barrier to pass-through of an object comprising a ball having a predetermined diameter of about four inches.

11. The railing system set forth in claim 10 wherein:

said first and second balusters are arranged in a pattern in said railing system for a stairway having a slope of between 25° and 50° while forming said continuous barrier to pass-through of said object.

12. A railing system for use as a stairway and a balcony having an elongated base support member and an elongated handrail adapted to be supported spaced from and above said base support member, said railing system comprising:

a plurality of spaced apart first balusters supported on said base support member and connected to said handrail, each of said first balusters having at least a first, generally vertically extending rodlike stanchion part having opposed ends operable to be supported by said base support member and said handrail, respectively, and a barrier part having a predetermined ornamental shape connected to said first stanchion part and extending laterally from said first stanchion part, said barrier parts of said first balusters being of an ornamental shape such as to provide a predetermined ornamental pattern when arranged as a balcony railing and as a stairway railing, spaced apart second balusters each comprising a single rodlike stanchion part and a barrier part, said single rodlike stanchion part extending from one side of said barrier part of each of said second balusters, respectively, and being operable to be supported by one of said base support member and said handrail, respectively, a pair of said second balusters spaced apart vertically with their respective rodlike stanchion parts inserted in said base support member and said handrail, respectively, and an ornamental barrier part disposed between said pair of said second blusters and connected to each of said second balusters, respectively, and said barrier parts of at least said first balusters being curved out of a plane containing said first stanchion part at a predetermined radius of curvature for forming one of a generally horizontally curved balcony railing and a curved stairway railing while forming a continuous barrier to pass-through of an object comprising a ball having a predetermined diameter of about four inches.

13. In a railing system for use at a stairway having a slope of between about 25° to 50° and at a generally horizontal balcony, a plurality of spaced apart balusters each comprising a single elongated rodlike stanchion part having opposed distal ends supported by a base member and a handrail of said stairway and said balcony, respectively, and a barrier part connected to said stanchion part and projecting laterally therefrom, each of said barrier parts comprising plural curved scroll-like portions providing a single predetermined pattern when said balusters are disposed in said railing system at a balcony and a stairway, each of said barrier parts having an overall length of between about 30 inches to 40 inches, an overall width of between about 10 inches to 12 inches and a radius of curvature out of a plane containing said stanchion parts of not less than about 48 inches, and said stanchion parts and said barrier parts cooperate to provide a predetermined maximum pass-through dimension for said railing system defined by a ball of a diameter of not more than about four inches.

14. A railing system for use as a stairway and a balcony having an elongated base support member and an elongated handrail adapted to be supported spaced from and above said base support member, said railing system comprising:

a plurality of spaced apart balusters supported on said base support member and connected to said handrail, each of said balusters including a single vertically extending rodlike stanchion part having opposed ends operable to be supported on said base support member and operably connected to said handrail, respectively, and a barrier part having a predetermined ornamental shape connected to said stanchion part and extending laterally from only one side of said stanchion part, said barrier parts of said balusters being of an ornamental shape such as to provide a predetermined ornamental pattern when arranged as a balcony railing and as a stairway railing having a slope of between about 25° to 50°, and said barrier parts being disposed to occupy space between said base support member and said handrail when arranged as a balcony railing and as a stairway railing while forming a continuous barrier to pass-through of an object comprising a ball having a predetermined diameter of about four inches.

* * * * *